US006621205B1

(12) United States Patent
Kim et al.

(10) Patent No.: US 6,621,205 B1
(45) Date of Patent: Sep. 16, 2003

(54) ELECTRON GUN IN COLOR CATHODE RAY TUBE

(75) Inventors: Moon Sik Kim, Kyongsangbuk-do (KR); Sung Ho Cho, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 209 days.

(21) Appl. No.: 09/637,784

(22) Filed: Aug. 11, 2000

(30) Foreign Application Priority Data

Aug. 13, 1999 (KR) ..... 1999-33435

(51) Int. Cl.[7] ..... H01J 29/62
(52) U.S. Cl. ..... 313/448; 313/414; 313/460
(58) Field of Search ..... 313/414, 417, 313/421, 426, 427, 441, 446, 448, 460, 451, 458

(56) References Cited

U.S. PATENT DOCUMENTS 5,877,587 A * 3/1999 Trinchero et al. ..... 313/414
6,271,625 B1 * 8/2001 Van Engelshoven et al. ..... 313/414

* cited by examiner

*Primary Examiner*—Vip Patel
*Assistant Examiner*—K A Berck
(74) *Attorney, Agent, or Firm*—Fleshner & Kim, LLP

(57) ABSTRACT

Electron gun in a color cathode ray tube including a separate plate electrode having a thickness thicker than a focusing electrode or an anode, a smooth outer circumference of a rim part, and single electron beam pass through hole for passing of three electron beam in common each fitted to opposite edges of the focusing electrode and the anode, thereby preventing deformation of the plate electrodes, enlarging diameters of the electron beam pass through holes, to allow formation of accurate large sized main focusing electrostatic lens, improving focusing onto a screen, and preventing occurrence of discharge between the focusing electrode and the anode.

28 Claims, 6 Drawing Sheets

Dic : spot diameter of thermal electron beam by spherical aberration

Dst : spot diameter of thermal electron beam by spatial charge repulsive force

Dt : spot diameter on screen

ELECTRON GUN IN COLOR CATHODE RAY TUBE

BACKGROUND OF THE INVENTION

1. Field of the Invention

The present invention relates to an electron gun in a color cathode ray tube or a high definition industrial monitor, and more particularly, to an electron gun in a color cathode ray tube which can form a large sized main focusing electrostatic lens.

2. Background of the Related Art

FIG. 1 illustrates a cross section of a related art color cathode ray tube.

Referring to FIG. 1, the related art color cathode ray tube is provided with a panel 1 having red, green, and blue fluorescent materials coated on an inside surface thereof, a funnel 2 fixed to a rear of the panel 1, an electron gun 5 in a neck part 3 of the funnel 2 for emitting electron beams 4 toward a screen, a deflection yoke 6 mounted around an outer circumferential surface of the neck part 3 for deflecting the electron beams 4 emitted from the electron gun 5 in up, down, left, right directions, and subjecting the electron beams to self convergence, and a shadow mask 7 provided close to the inside surface of the panel 1 for selective pass of the electron beams 4. The electron gun 5 has three independent cathodes 8 arranged on a horizontal line for emission of the electron beams, a control electrode 9, an acceleration electrode 10, a pre-focusing electrode 11, a first focusing electrode 12, a second focusing electrode 13 having horizontal electrodes 133*b* on upper and lower sides of electron beam through holes 133*a*; an anode 14, and a shield cup 15 for shielding a geomagnetism.

When the aforementioned cathode ray tube is put into operation, the electron beams are emitted from the cathode 8, and controlled, accelerated, and pre-focused as the electron beams pass through the control electrode 9, the acceleration electrode 10, and the pre-focusing electrode 11. Then, the electron beams are converged in a horizontal direction and diverged in a vertical direction by a dynamic quardrupole lens formed by a voltage difference of the first and second focusing lenses 12 and 13 and a horizontal lens 131*b*, focused mainly by a main focusing electrostatic lens formed by a voltage difference of the second focusing electrode 13 and the anode 14, and accelerated into an inside of the cathode ray tube by the anode. In continuation, the electron beams are deflected in up, down, left, right directions and subjected to self convergence on the same time by a deflection signal from the deflection yoke 6. While the deflection yoke 6 subjects the electron beams to self convergence, it has a drawback in that the electron beams are converged in up and down directions and diverged in left and right directions. However, as the electron beams are pre-corrected by the dynamic quardrupole lens, the electron beams 4 passed through the deflection yoke 6 are directed to the shadow mask 7 without any distortion, selectively pass through the shadow mask 7, land on a fluorescent surface 16 of the fluorescent materials, to form a picture. A quality of the picture formed thus can be made the better as a spot diameter of the electron beam landed on the fluorescent surface are made the smaller.

In general, the spot diameter of the electron beams on a screen is influenced from a magnification of a lens, a spatial charge repulsive force, a spherical aberration of the main focusing electrostatic lens, and the like. Since the influence of the lens magnification on the spot diameter Dx of the electron beams is defined by a basic voltage condition, a focus distance, a length of the electron gun, and the like, it is of little use, and has very little significance as a design parameter of the electron gun. The spatial charge repulsive force is a phenomenon in which the spot diameter of the electron beams are enlarged as the electrons in the electron beams repulse and collide to one another. Therefore, for reducing enlargement of the spot diameter Dst of the electron beams caused by the spatial charge repulsive force, it is favorable that a travelling angle of the electron beams(called "a diverging angle") is designed to be great. Different from the spatial charge repulsive force, the spherical aberration of the main focusing electrostatic lens implies an enlarged spot diameter Dic of the electron beams caused by a difference of focus distances of electrons passed through a radical axis of the lens and electrons passed through a protaxis of the lens. Therefore, the smaller the diverging angle of the electron beams incident to the main focusing electrostatic lens, the smaller spot diameter of the electron beams can be obtained on the screen. In general, a spot diameter Dt of the electron beams on the screen can be expressed as the following equation.

$$Dt=\sqrt{(Dx+Dst)^{2+Dic^2}}$$

Both the spatial charge repulsive force and the spherical aberration can be reduced by enlargement of a diameter of the main focusing electrostatic lens. That is, the enlargement of the main focusing electrostatic lens diameter can reduce the spatial charge repulsive force because the diverging angle is made great, and can also reduce the spherical aberration because the electron beams can pass a radical axis of the main focusing electrostatic lens.

FIG. 2 illustrates a graph showing a diameter of a main focusing electrostatic lens vs. a spot diameter.

Referring to FIG. 2, it can be known that the greater the diameter of the main focusing electrostatic lens, the less the enlargement of the spot diameter caused by the spherical aberration of the main focusing electrostatic lens, resulting to reduce the spot diameter of the electron beams on the screen. In general, a size of the diameter of the main focusing electrostatic lens is proportional to sizes of electron beam pass through holes formed in opposite surfaces of the second focusing electrode 13 and the anode 14. Therefore, for maximizing the diameter of the main focusing electrostatic lens, it is known that single electron beam pass through hole for passing of the three electron beams in common is formed in each of the opposite second focusing electrode 13 and the anode 14.

FIG. 3 illustrates a half section of a second focusing electrode 13 and an anode 14 for forming a large sized main focusing electrostatic lens in a related art electron gun, and FIG. 4 illustrates a perspective view of the second focusing electrode 13 and the anode 14 shown in FIG. 3 with a partial cut away view.

Referring to FIGS. 3 and 4, the second focusing electrode 13 is provided with a first cup formed electrode 131 having one end opened to the cathode 8, and the other end with a rim part 131*b* of a horizontally elongated track form as a unit therewith to form single electron beam pass through hole for passing the three electron beams in common, an electrostatic field electrode 132 having one side fixed to the one end of the first cup formed electrode 131 and three electron beam pass through holes 132*a* formed therein, and a second cup formed electrode 133 having one opened end fixed to the other side of the electrostatic field electrode 132, three electron beam pass through holes 133*a*, and horizontal electrodes 133*b* fitted to an upper portion and a lower portion of respective electron beam pass through holes 133*a*. The anode 14 is provided with a third cup formed electrode 141 having one end opened to the panel 1, and the other end opposite to the rim part 131*b* of the second focusing electrode 13 with a rim part 141*b* of a horizontally elongated track form as a unit therewith to form a thermal electron beam pass through hole 141*a* for passing of the three electron-beams in common, an electrostatic field electrode 142 having one side fixed to the one end of the third cup formed electrode 141 and three electron beam pass through holes 142*a*, a fourth cup formed electrode 143 having one opened end fixed to the other side of the electrostatic field electrode 142, and the other end with single electron beam pass through hole 143*a* for passing of the three electron beams in common, and a shield cup fixed to the other end of the fourth cup formed electrode 143. And, there is a flange part 132*c* or 142*c* on an upper portion and a lower portion of each of the electrostatic field electrodes 132 and 142 buried in and fixed to bead glass 17.

In the foregoing system, when the cathode ray tube is put into operation, there is a large sized main focusing lens formed in a space between the second focusing electrode 13 and the anode 14. However, the horizontally elongated electron beam pass through holes 131*a* and 141*a* leads the main focusing electrostatic lens to having a weak horizontal focusing power and a strong vertical focusing power. However, as the electrostatic field control electrodes 132 and 142 respectively fixed to the second focusing electrode 13 and the anode 14 serve to adjust the horizontal and vertical focusing powers for the electron beams identical, the electron beams passed through the main focusing electrostatic lens are focused the same in the horizontal and the vertical directions.

In the meantime, an original form of the system shown in FIGS. 3 and 4 has burring parts 131*d* and 141*d* as shown in FIG. 7A on inner circumferences of the rim parts 131*b* and 141*b* of the second focusing electrode 13 and the anode 14 extended toward the electrostatic field control electrodes 132 and 142, for reinforcing a weak deformation strength of the rim parts 131*b* and 141*b*. However, the burring parts 131*d* and 141*d* formed by pressing reduce horizontal and vertical diameters H and V of the electron beam pass through holes 131*a* and 141*a* in the rim parts 131*b* and 141*b* (called "rim part hole diameter"). Therefore, as shown in FIG. 7B, in order to enlarge the rim part hole diameters H and V, the burring parts 131*d* and 141*d* in FIGS. 3 and 4 are removed, to use the second focusing electrode 13 and the anode 14 having the rim parts 131*b* and 141*b* only in the electron gun. However, even in the example of FIGS. 3 and 4, because a diameter of the neck part 3 is limited to 27 mm, and the rim parts 131*b* and 141*b* are formed by pressing, the rim part hole diameters are limited to 19.6 mm(H1) in the horizontal direction, and 9.2 mm(V1) in the vertical direction. And, since the removal of the burring parts 131*d* and 141*d* causes the rim parts 131*b* and 141*b* weaker to deformation, there is an error occurred in a symmetry between the rim part hole diameters H and V and the electron beam pass through holes 132*a* and 142*a* in the electrostatic field control electrodes 132 and 142, which causes a problem in focusing on the screen. The inevitable roughness of inside circumferential surface of the rim parts 131*b* and 141*b* due to the pressing causes discharge between the second focusing electrode 13 and the anode 14 by a voltage difference, which gives damages to the circuit and the cathode, and causes noises on the screen.

SUMMARY OF THE INVENTION

Accordingly, the present invention is directed to an electron gun in a color cathode ray tube that substantially obviates one or more of the problems due to limitations and disadvantages of the related art.

An object of the present invention is to provide an electron gun in a color cathode ray tube, which can prevent opposite rim parts on a focusing electrode and an anode and enlarge hole diameters in the rim parts for improving focusing onto the screen and prevents discharge between the focusing electrode and the anode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the electron gun in a color cathode ray tube includes a triode including a plurality of cathodes for emission of electron beams, a control electrode for controlling amounts of emission of the electron beams, and an acceleration electrode for accelerating the electron beams, a pre-focusing electrode for pre-focusing the electron beams, an anode and a focusing electrode for forming a main lens for focusing the electron beams, rim parts each provided to opposite edges of the focusing electrode and the anode for passing of the three electron beams in common, and electrostatic field control electrodes each spaced away from respective rim parts, and provided to insides of the focusing electrode and the anode, wherein the focusing electrode includes a first cup formed electrode having one end opened to a screen, and the other end with electron beam pass through holes formed therein, and a second cup formed electrode fixed to the first cup formed electrode having one opened end, and the other end with electron beam pass through holes formed therein, the anode includes a third cup formed electrode having one end opened to the cathodes, and the other end with electron beam pass through holes formed therein, and a fourth cup formed electrode having one opened end fixed to the first cup formed electrode, and the other end with electron beam pass through holes formed therein, and the rim parts being separate first and second plate electrodes fitted to the opened ends of the first and third cup formed electrodes, respectively.

The electrostatic field control electrode to each of the focusing electrode and the anode is an abut portion of the other ends of the first and second cup formed electrodes and the other ends of the third and fourth cup formed electrodes, respectively. Each of the first and second plate electrodes includes a flange on each of upper and lower sides thereof buried in, and fixed to bead glass.

In another aspect of the present invention, the electrostatic field control electrode to the focusing electrode is a third plate electrode fitted between the other end of the first cup formed electrode and one end of the second cup formed electrode, and the electrostatic field control electrode to the anode is a fourth plate electrode fitted between the other end of the third cup formed electrode and the one end of the fourth cup formed electrode, wherein each of the third and fourth plate electrodes includes a flange on each of upper and lower sides thereof buried in, and fixed to bead glass.

In the another aspect of the present invention, flanges buried in, and fixed to bead glass are provided, not to the first and second plate electrodes, but to the third and fourth plate electrodes, for preventing the first and second plate electrodes from taking vertical pressures from the bead glass.

In the present invention, an outer side of an inside circumference of each of the first and second plate electrodes is tapered, for prevention of discharge occurrence, and the first and second plate electrodes have a thickness of 0.7–2.0 mm, thicker than the first and second cup formed electrodes for positive prevention of deformation of the first and second plate electrodes.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings.

The electron gun in a color cathode ray tube of the present invention basically includes a plurality of cathodes for emission of electron beams, a control electrode for controlling amounts of emission of the electron beams, an acceleration electrode for accelerating the electron beams, a pre-focusing electrode for pre-focusing the electron beams, and an anode and a focusing electrode for forming a main focusing electrostatic lens for focusing the electron beams. Particularly, in the first and second embodiments of the present invention, the focusing electrode is divided into two. That is, the focusing electrode consists of a first focusing electrode and a second focusing electrode for formation of a dynamic quardrupole lens by a voltage difference to the first focusing electrode. A system of the electron gun of the present invention has the same system with the related art electron from the cathodes up to the first focusing electrode. The electron gun of the present invention is characterized in the second focusing electrode and the anode which form the main focusing electrostatic lens according to a voltage difference. The present invention has a system identical to the related art from the cathodes to the first focusing electrode, which will be omitted, and the second focusing electrode and the anode only will be explained.

Figure 5:
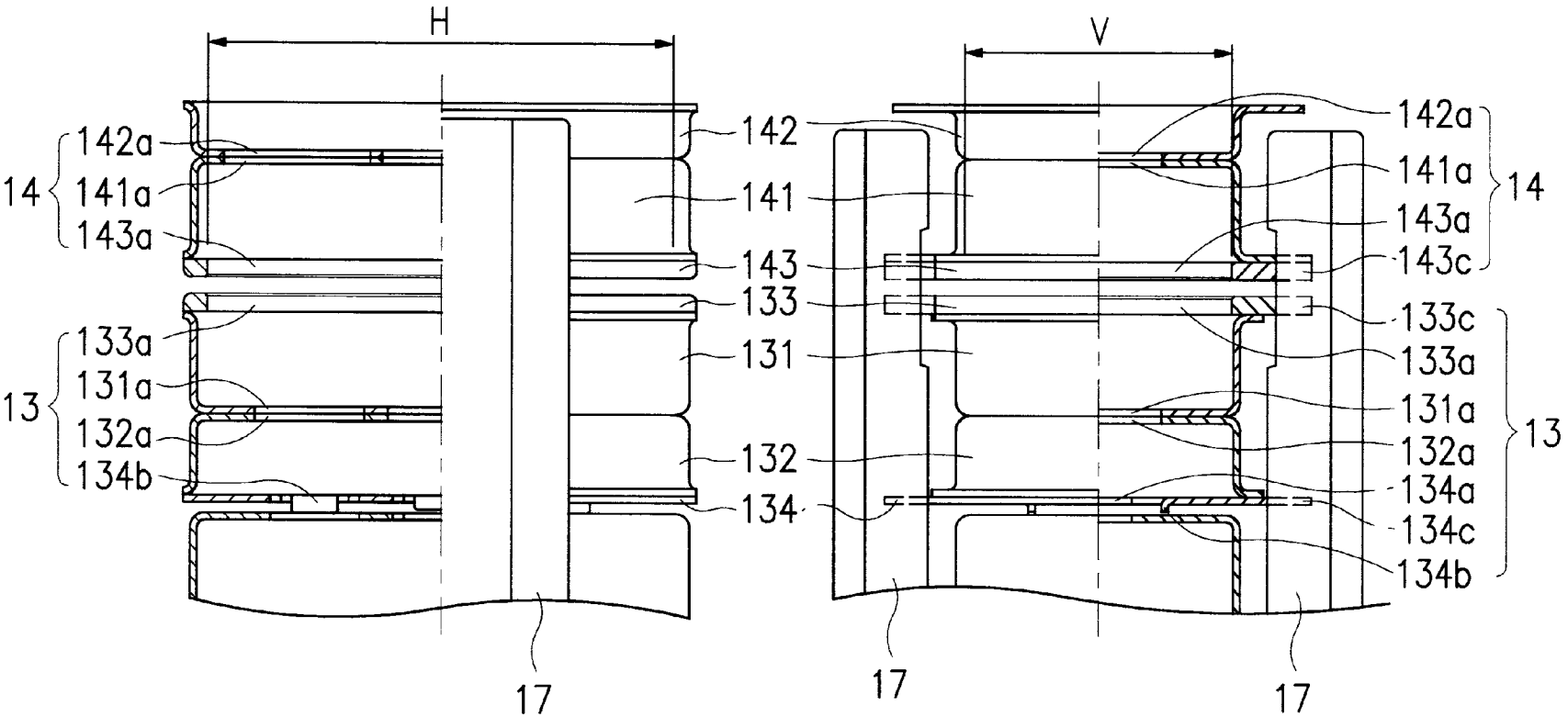
FIG. 5 illustrates a half section of an electron gun in a color cathode ray tube in accordance with a first preferred embodiment of the present invention.

FIG. 5 illustrates a half section of an electron gun in a color cathode ray tube in accordance with a first preferred embodiment of the present invention.

Figure 3:
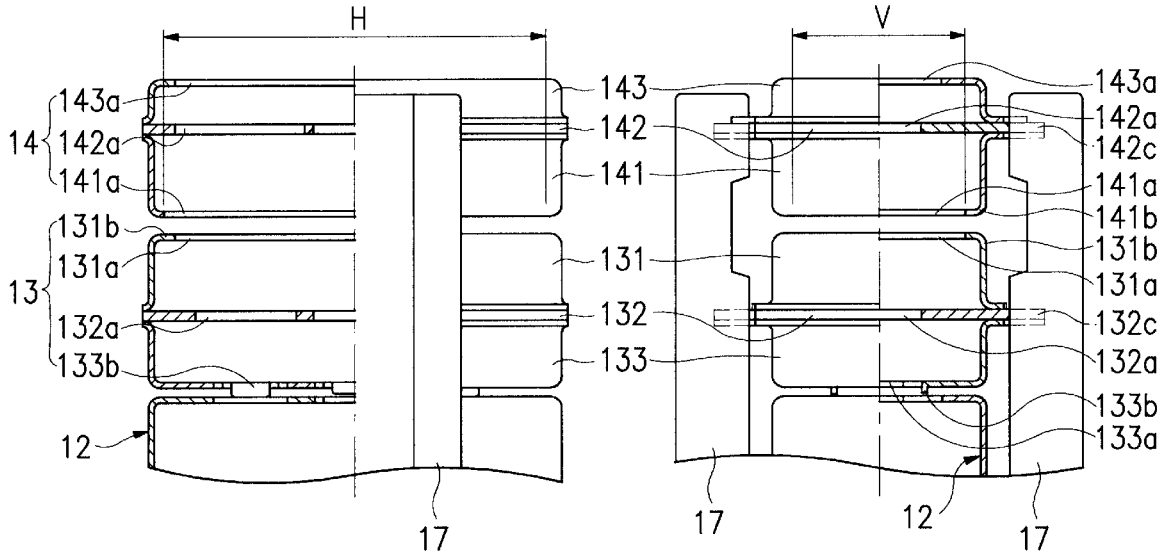
FIG.3 Prior Art
FIG. 3 illustrates a half section of a second focusing electrode and an anode for forming a large sized main focusing electrostatic lens in a related art electron gun.
Figure 4:
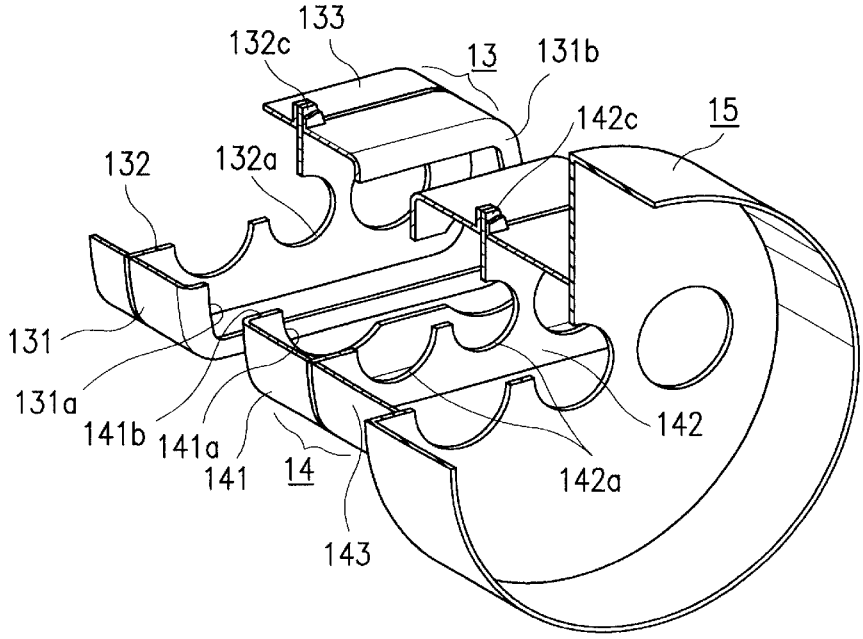
FIG.4 Prior Art
FIG. 4 illustrates a perspective view of the second focusing electrode and the anode shown in FIG. 3 with a partial cut away view.

Referring to FIG. 5, the electron gun in a color cathode ray tube in accordance with a first preferred embodiment of the present invention includes a first focusing electrode 12, a second focusing electrode 13 for forming a dynamic quardrupole lens according to a voltage difference to the first focusing electrode 12, and an anode 14 for having a positive voltage applied thereto. The second focusing electrode 13 includes a first cup formed electrode 131 having an opened one end to the screen, and the other end with three electron beam pass through holes 13 la formed therein, a second cup formed electrode 132 having one end fixed to the other end of the first cup formed electrode with three electron beam pass through holes 132*a* formed therein and the other end opened to the cathodes, a first plate electrode 133 fixed to the one end of the first cup formed electrode 131 having single electron beam pass through hole 133*a* of a horizontally elongated track form for passing of the three electron beams formed therein, and a fifth plate electrode 134 having one side fixed to the other end of the second cup formed electrode 132 and three electron beam pass through holes 134*a*. The anode 14 includes a third cup formed electrode 141 having one end opened to the cathodes, and the other end with three electron beam pass through holes 141*a* formed therein, a fourth cup formed electrode 142 having one end fixed to the other end of the third cup formed electrode 141 with three electron beam pass through holes 142*a* formed therein, and the other end opened to the screen, and a second plate electrode 143 fixed to the one end of the third cup formed electrode 141 having single electron beam pass through hole 143*a* of a horizontally elongated track form for passing of the three electron beams. An abut portion of the first and second cup formed electrodes 131 and 132 and an abut portion of the third and fourth cup formed electrodes 141 and 142 act as the electrostatic field control electrodes 132 and 142 in the electron gun of the related art color cathode ray tube shown in FIGS. 3 and 4, respectively. An outer part of an inner circumference of the first and second plate electrodes 133 and 143 are smoothly tapered by pressing enough to prevent occurrence of discharge between the second focusing electrode 13 and the anode 14. In the first embodiment electron gun of the present invention, there is a horizontal electrode 134*b* fitted to upper side and lower side of each of the electron beam pass through holes 134*a* in the other side of the fifth plate electrode 134, to form a dynamic quardrupole lens between the first and second focusing electrodes 12 and 13 by a voltage difference between the first focusing electrode 2 and the second focusing electrode 13 and the horizontal electrodes 134*b*. And, there are flanges 133*c*, 143*c* and 134*c* on upper side and lower side of the first, second and fifth plate electrodes 133, 143, and 134 buried in and fixed to bead glass 17. However, particularly, the flanges 133*c* and 143*c* can receive a possible vertical pressures which may be formed in burying the flanges 133*c* and 143*c* into the bead glass 17 as they are, to deform the first and second plate electrodes 133 and 143. Moreover, there is a possibility of discharge occurrence as areas of facing surfaces of the plate electrodes 133 and 143 are increased by areas of the flanges 133*c* and 143*c*. Those drawbacks of the first embodiment of the present invention can be overcome by the second embodiment of the present invention, which will be explained hereafter.

Figure 6:
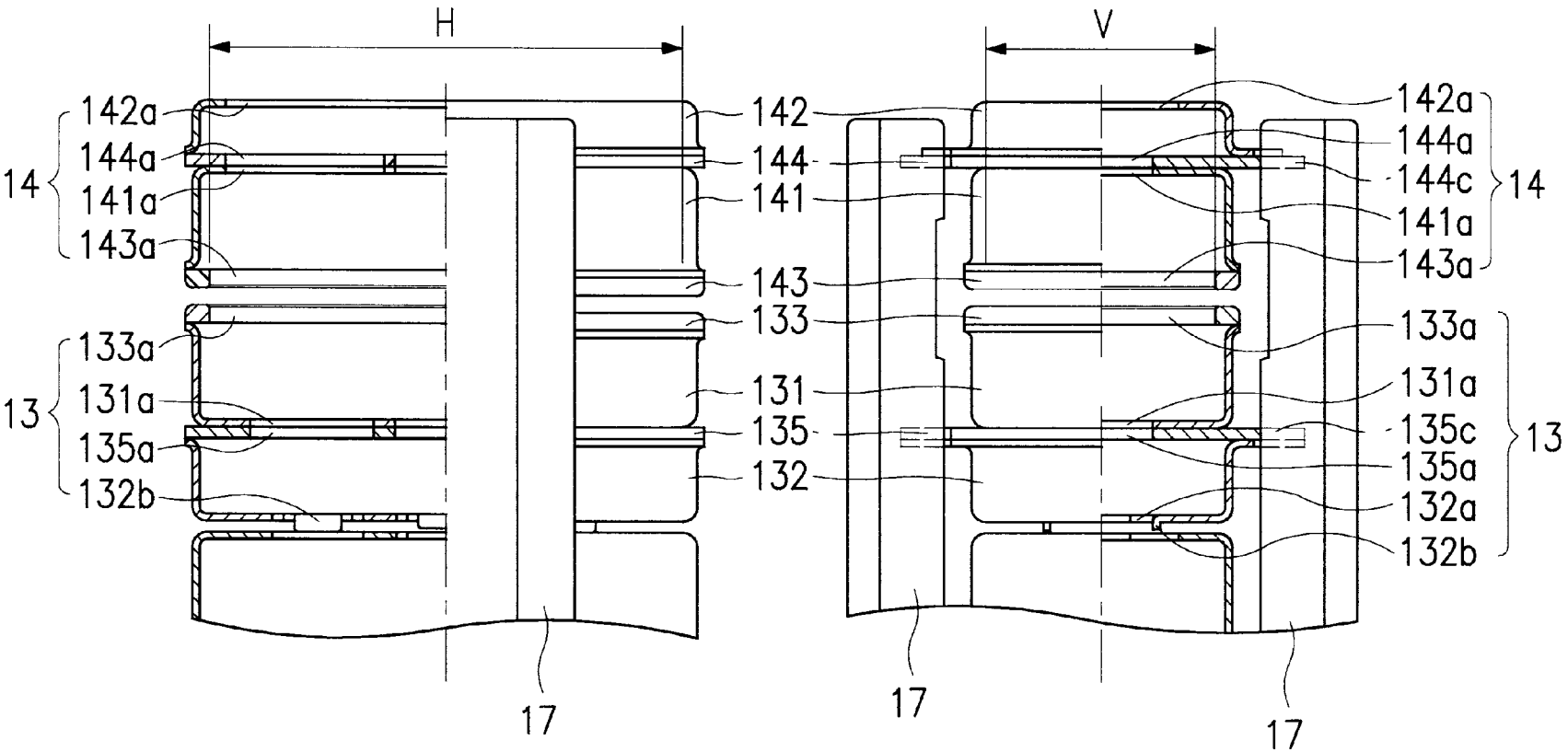
FIG. 6 illustrates a half section of an electron gun in a color cathode ray tube in accordance with a second preferred embodiment of the present invention; and, FIGS. 7A~7C illustrate sections of opposite parts of main focusing electrostatic lenses of the present invention and the related art.

FIG. 6 illustrates a half section of an electron gun in a color cathode ray tube in accordance with a second preferred embodiment of the present invention.

Figure 1:
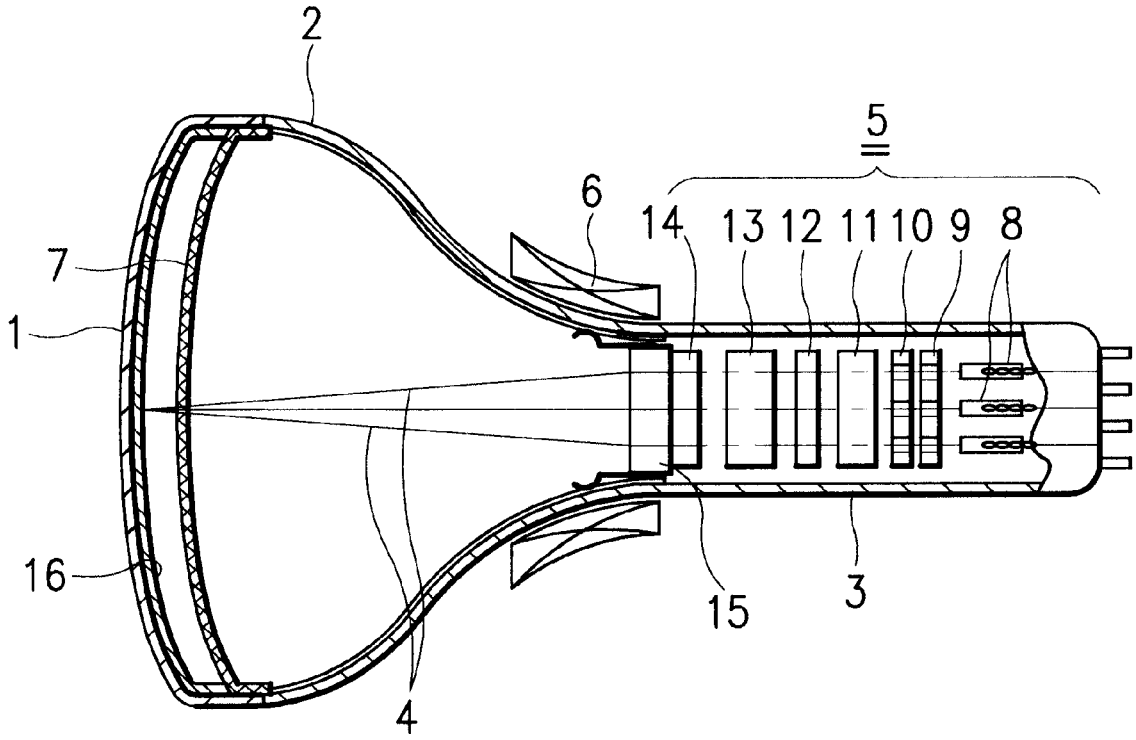
FIG.1 Prior Art
FIG. 1 illustrates a cross section of a related art color cathode ray tube.
Figure 2:
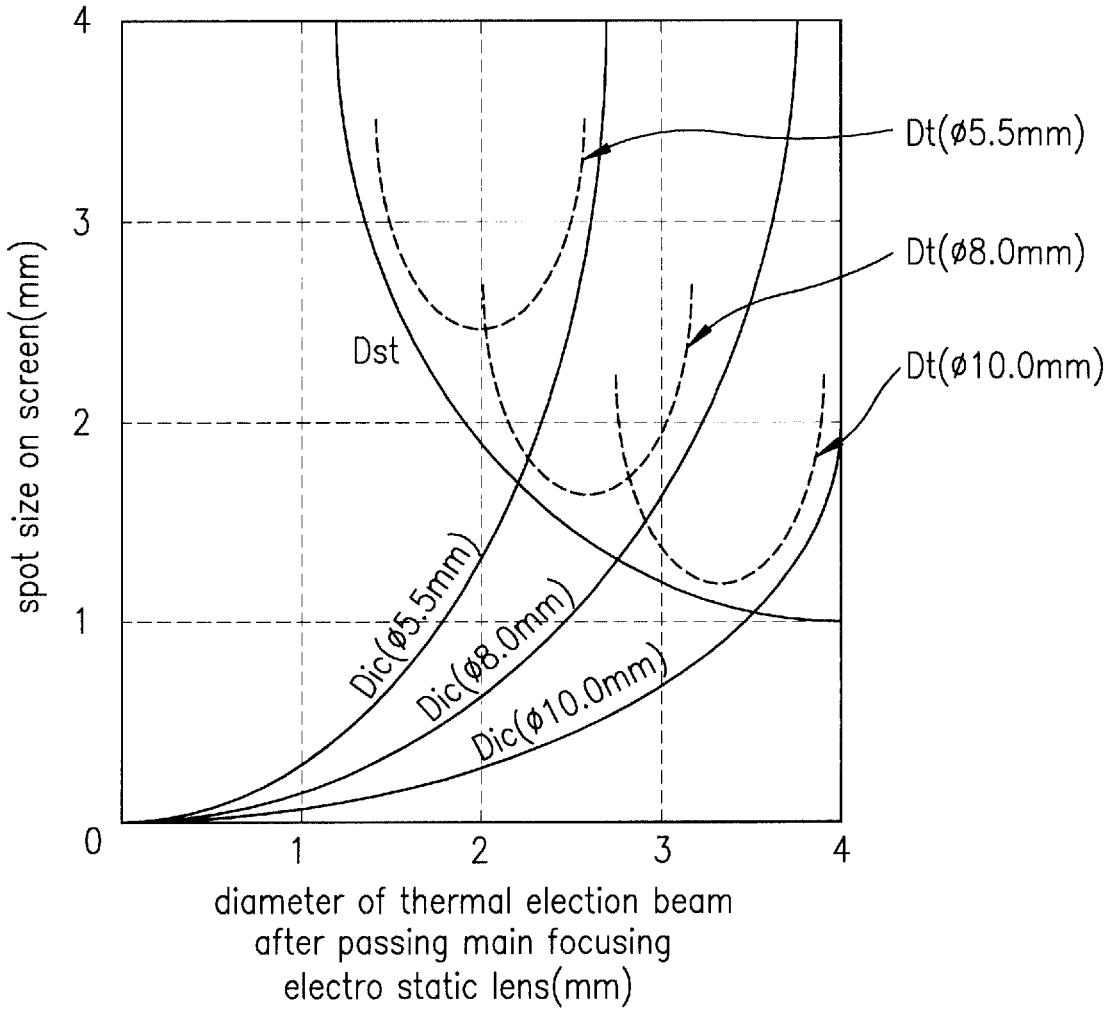
FIG.2 Prior Art
FIG. 2 illustrates a graph showing a diameter of a main focusing electrostatic lens vs. a spot diameter.
Figure 7A:
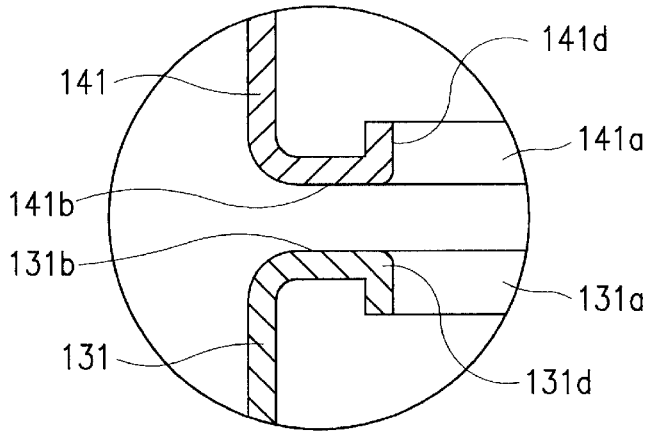
FIG.7A Prior Art
Figure 7B:
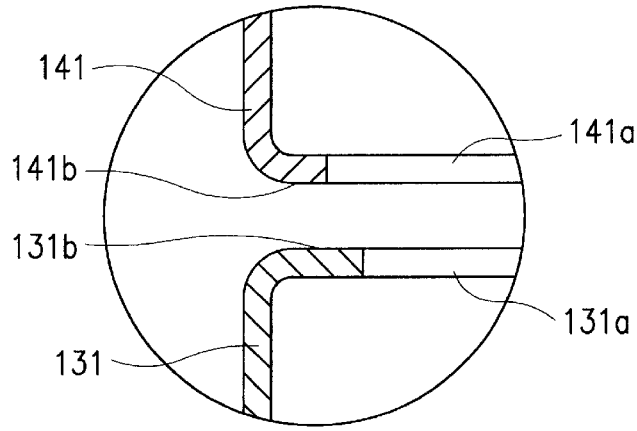
FIG.7B Prior Art
Figure 7C:
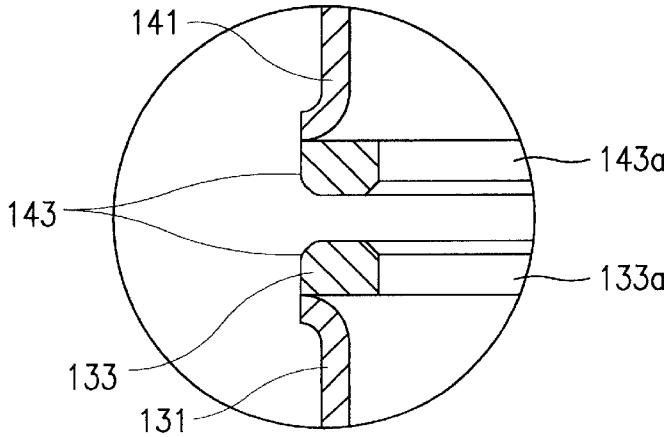

Referring to FIG. 6, alike the first embodiment of the present invention, the electron gun in a color cathode ray tube in accordance with a second preferred embodiment of the present invention includes a second focusing electrode 13, and an anode 14. The second focusing electrode 13 includes a first cup formed electrode 131 having one end opened to the screen, and the other end with three electron beam pass through holes 131*a*, a third plate electrode 135 having one side fixed to the other end of the first cup formed electrode 131 and three electron beam pass through holes 135*a*, a second cup formed electrode 132 having one opened end fixed to the other side of the third plate electrode 135 and the other end with three electron beam pass through holes 132*a*, and a first plate electrode 133 fixed to the one end of the first cup formed electrode 131 having single electron pass through hole 133*a* of a horizontally elongated track form for passing of the three electron beams. The anode 14 includes a third cup formed electrode 141 having one end opened to the cathodes, and the other end with three electron beam pass through holes 141*a*, a fourth plate electrode 144 having one side fixed to the other end of the third cup formed electrode 141 and three electron beam pass through holes 144*a* formed therein, a fourth cup formed electrode 142 having one opened end fixed to the other side of the fourth plate electrode 144 and the other end with single electron beam pass through hole 142*a*, and a second plate electrode 143 fixed to one end of the third cup formed electrode 141 and single electron beam pass through hole 143*a* of a horizontally elongated track form for passing of the three electron beams. In this instance, the other end of the first cup formed electrode 131, the third plate electrode 135, and the other end of the third cup formed electrode 141 act the same as the electrostatic field control electrodes 132 and 142 in the electron gun of the related art color cathode ray tube shown in FIGS. 2 and 3. And, there is a horizontal electrode on the other side of upper side and lower side of each of the electron beam pass through holes 132*a*, to form a dynamic quardrupole lens between the first and second focusing electrodes 12 and 13 by a to voltage difference between the first focusing electrode 12 and the second focusing electrode 13 and the horizontal electrodes 132*b*. There are flanges 135*c* and 144*c* on upper side and lower side of the third and fourth plate electrodes 135 and 144 buried in and fixed to bead glass 17. Alike the first embodiment of the present invention, though the second embodiment of the present invention is provided with the first and second plate electrodes 133 and 143 of horizontally elongated track forms for passing of the three electron beams in common, the second embodiment of the present invention is provided with flanges on upper side and lower side of the first and second plate electrodes 133 and 143. Therefore, even when the flanges 135*c* and 144*c* are buried in the bead glass 17, the first and second plate electrodes 133 and 143 receive no vertical pressure from the bead glass, resulting in no deformation. Eventually, the main focusing lens formed between the second focusing electrode 13 and the anode 14 is very accurate, to permit an improvement in the focusing on the screen. And, as there are no flanges provided to the first and second plate electrodes 133 and 143 in the second embodiment of the present invention, the facing areas between the first and second plate electrodes 133 and 143 can be minimized, leading to a reduction of a possibility of discharge occurrence. Moreover, as shown in FIG. 7C, the smooth taper at an outer side of the inside circumference of the first and second plate electrodes 133 and 143 done by separate pressing process can prevent occurrence of discharge between the second focusing electrode 13 and the anode 14, more positively.

In the meantime, in the first and second embodiments of the present invention, the first and second plate electrodes 133 and 135 mounted opposite to the second focusing electrode 13 and the anode 14 have a thickness of 0.7~2.0 mm for providing an adequate strength against deformation in fabrication of the electron gun. If the thickness is less than 0.7 mm, rims of the first and second plate electrodes 133 and 134 may deform in fabrication of the electron gun, and if the thickness is greater than 2.0 mm, a life time of a mold can be shortened in the pressing. In the first and second embodiments of the present invention, the rim part hole diameters of the first and second plate electrodes 133 and 143 can be enlarged to 20.5 mm(H2) in the horizontal direction and to 10.5 mm(V2) in the vertical direction by individual pressing of the first and second plate electrodes 133 and 143, corresponding to the opposite surfaces of the second focusing electrode 13 and the anode 14 respectively, at first, and fixing the first and third cup formed electrodes 131 and 141 thereto, respectively.

Table 1 shows a comparison of the rim part hole diameters of the first and second plate electrodes 133 and 143 fixed opposite edges to the anode 14 and the second focusing electrode 13 respectively versus the diameter of the main focusing electrostatic lens.

TABLE 1

| | Rim part hole diameters(mm) | | Diameters of main lens(mm) | |
|---|---|---|---|---|
| No. | Horizontal | Vertical | Horizontal | Vertical |
| 1 | 18.0 | 7.0 | ϕ8.0 | ϕ7.2 |
| 2 | 19.0 | 8.0 | ϕ8.8 | ϕ7.8 |
| 3 | 19.6 | 9.2 | ϕ9.4 | ϕ8.2 |
| 4 | 20.5 | 10.5 | ϕ11.2 | ϕ9.8 |

As shown in table 1, it can be known that the greater the rim part hole diameters of the first and second plate electrodes 133 and 143, the greater the diameter of the main focusing electrostatic lens, to an extent of 19% in the horizontal direction and 20% in the vertical direction.

As has been explained, the electron gun in a color cathode ray tube of the present invention has the following advantages.

First, the dimensional enlargement of the rim parts which form the main focusing electrostatic lens to the maximum permits enlargement of lens diameters compared to the same to of the related art by 19% in a horizontal direction and 20% in a vertical direction.

Second, the increased thickness of the plate electrode which form the rim part from 0.4 mm in the related art to 0.7 mm in the present invention permits to prevent deformation of the first and second plate electrodes caused by the vertical pressure from the bead glass in fabrication of the electron gun, that allows to provide an accurate main focusing electrostatic lens.

Third, the smooth taper at the outer side of the inside circumference of the plate electrode by separate pressing permits to prevent discharge between the second focusing electrode and the anode.

It will be apparent to those skilled in the art that various modifications and variations can be made in the electron gun in a color cathode ray tube of the present invention without departing from the spirit or scope of the invention. Thus, it is intended that the present invention cover the modifications and variations of this invention provided they come within the scope of the appended claims and their equivalents.

What is claimed is:

1. An electron gun in a color cathode ray tube, comprising:

a triode including a plurality of cathodes for emission of electron beams, a control electrode for controlling amounts of emission of the electron beams, and an acceleration electrode for accelerating the electron beams;

a pre-focusing electrode for pre-focusing the electron beams;

an anode and a focusing electrode for forming a main lens for focusing the electron beams;

rim parts each provided on opposite edges of the focusing electrode and the anode for passing of the three electron beams in common; and electrostatic field control electrodes each spaced away from the respective rim parts, and provided on insides of the focusing electrode and the anode, wherein the focusing electrode includes:

a first cup formed electrode having an open end facing a screen, and a first bottom surface having a first plurality of electron beam pass through holes formed therein; and a second cup formed electrode having an open end facing the cathodes, and a second bottom surface having a second plurality of electron beam pass through holes formed therein, the second bottom surface being fixed to and in contact with the first bottom surface; and wherein the anode includes:

a third cup formed electrode having an open end facing the cathodes, and a third bottom surface having a third plurality of electron beam pass through holes formed therein; and a fourth cup formed electrode having an open end facing the screen, and a fourth bottom surface having a fourth plurality of electron beam pass through holes formed therein, the fourth bottom surface being fixed to and in contact with the third bottom surface; and wherein the rim parts include separate first and second plate electrodes fixed to the open ends of the first and third cup formed electrodes, respectively.

2. The electron gun as claimed in claim 1, wherein each of the first and second plate electrodes includes a flange on each of upper and lower sides thereof buried in, and fixed to bead glass.

3. The electron gun as claimed in claim 1, wherein an outer side of an inside circumference of each of the first and second plate electrodes is tapered.

4. The electron gun as claimed in claim 3, wherein the first and second plate electrodes have a thickness of 0.7~2.0 mm.

5. An electron gun in a CRT, comprising:

a plurality of cathodes configured to emit electron beams; and a focusing assembly configured to focus the electron beams directed to a screen, wherein the focusing assembly includes:

an anode having a first cup shaped electrode having an open end which faces the plurality of cathodes and a first bottom surface having a first plurality of electron beam pass through holes disposed therein, a first plate electrode fixed to the first bottom surface and having a second plurality of electron beam pass through holes, and a second cup shaped electrode having an open end fixed to the first plate electrode and a second bottom surface.

6. The electron gun as claimed in claim 5, wherein the focusing assembly further includes a focusing electrode disposed adjacent to the anode and wherein the focusing electrode includes:

a third cup shaped electrode having an open end which faces the screen and a third bottom surface having a third plurality of electron beam pass through holes disposed therein;

a second plate electrode fixed to the third bottom surface and having a fourth plurality of electron beam pass through holes; and a fourth cup shaped electrode having an open end fixed to the second plate electrode and a fourth bottom surface.

7. The electron gun as claimed in claim 5, further comprising a control electrode configured to control amounts of emission of the electron beams from the plurality of cathodes.

8. The electron gun as claimed in claim 7, further comprising an acceleration electrode configured to accelerate the electron beams.

9. The electron gun as claimed in claim 5, wherein the focusing assembly further includes a second plate electrode fixed to the open end of the first cup shaped electrode.

10. The electron gun as claimed in claim 6, wherein the focusing assembly further includes a pre-focusing electrode disposed adjacent the focusing electrode and configured to pre-focus the electron beams.

11. The electron gun as claimed in claim 6, wherein the focusing assembly further includes electrostatic field control electrodes provided for each of the anode and focusing electrode.

12. The electron gun as claimed in claim 6, wherein the focusing assembly further includes third and fourth plate electrodes fixed to the open ends of the first and third cup shaped electrodes.

13. The electrode gun as claimed in claim 12, wherein an outer edge of an inside circumference of each of the first and second plate electrodes is tapered.

14. The electron gun as claimed in claim 13, wherein the first and second plate electrodes have a thickness of 0.7~2.0 mm.

15. The electrode gun as claimed in claim 6, wherein each of the first and second plate electrodes includes a flange configured to be affixed to bead glass.

16. The electron gun as claimed in claim 5, wherein the electron gun is for a color cathode ray tube.

17. An electron gun in a CRT, comprising:

a plurality of cathodes configured to emit electron beams; and a focusing assembly configured to focus the electron beams directed to a screen, wherein the focusing assembly includes:

an anode having a first cup shaped electrode having an open end which faces the plurality of cathodes and a first bottom surface having a first plurality of electron beam pass through holes disposed therein, and a second cup shaped electrode having an open end which faces the screen and a second bottom surface having a second plurality of electron beam pass through holes disposed therein, wherein the second bottom surface is fixed to and in contact with the first bottom surface.

18. The electron gun as claimed in claim 17, wherein the focusing assembly further includes a focusing electrode disposed adjacent to the anode and wherein the focusing electrode includes:

a third cup shaped electrode having an open end which faces the screen and a third bottom surface having a third plurality of electron beam pass through holes disposed therein; and a fourth cup shaped electrode having an open end which faces the plurality of cathodes and a fourth bottom surface having a fourth plurality of electron beam pass through holes disposed therein, wherein the fourth bottom surface is fixed to and in contact with the third bottom surface.

19. The electron gun as claimed in claim 17, further comprising a control electrode configured to control amounts of emission of the electron beams from the plurality of cathodes.

20. The electron gun as claimed in claim 19, further comprising an acceleration electrode configured to accelerate the electron beams.

21. The electron gun as claimed in claim 17, wherein the focusing assembly further includes a first plate electrode fitted to the open end of the first cup shaped electrode.

22. The electron gun as claimed in claim 18, wherein the focusing assembly further includes a pre-focusing electrode disposed adjacent the focusing electrode and configured to pre-focus the electron beams.

23. The electron gun as claimed in claim 18, wherein the focusing assembly further includes electrostatic field control electrodes provided for each of the anode and focusing electrode.

24. The electron gun as claimed in claim 17, wherein the focusing assembly further includes first and second plate electrodes fitted to the open ends of the first and third cup shaped electrodes, respectively.

25. The electrode gun as claimed in claim 24, wherein each of the first and second plate electrodes includes a flange configured to be affixed to bead glass.

26. The electrode gun as claimed in claim 24, wherein the focusing assembly further includes a third plate electrode fitted to the open end of the fourth cup shaped electrode.

27. The electrode gun as claimed in claim 26, wherein the third plate electrode includes a flange configured to be affixed to bead glass.

28. The electron gun as claimed in claim 17, wherein the electron gun is for a color cathode ray tube.

* * * * *